US009674897B1

(12) United States Patent
Bellig et al.

(10) Patent No.: US 9,674,897 B1
(45) Date of Patent: Jun. 6, 2017

(54) HEATED WINDOW COVERING DEVICE

(71) Applicants: Nancy D. Bellig, Danube, MN (US); Dale Fahrenkamp, Danube, MN (US)

(72) Inventors: Nancy D. Bellig, Danube, MN (US); Dale Fahrenkamp, Danube, MN (US)

( * ) Notice: Subject to any disclaimer, the term of this patent is extended or adjusted under 35 U.S.C. 154(b) by 1008 days.

(21) Appl. No.: 13/934,906

(22) Filed: Jul. 3, 2013

(51) Int. Cl.
*H05B 1/00* (2006.01)
*H05B 3/84* (2006.01)

(52) U.S. Cl.
CPC ..... *H05B 3/84* (2013.01)

(58) Field of Classification Search
CPC ..... E04B 1/348; E04F 17/06; E06B 3/30
USPC ..... 219/200, 203, 213, 520, 521, 522
See application file for complete search history.

(56) References Cited

U.S. PATENT DOCUMENTS 3,048,900 A * 8/1962 Slade ..... E04F 17/06 16/267
4,871,204 A * 10/1989 Cook ..... E05B 47/0002 292/251.5
4,949,929 A * 8/1990 Kesselman ..... A47B 96/06 248/220.1
5,271,195 A 12/1993 Wahe
5,339,579 A * 8/1994 Woodyer ..... E04F 17/06 29/897.32
D484,990 S 1/2004 Ecker
7,014,226 B1 * 3/2006 Huang ..... E05B 47/0002 292/144
7,444,784 B2 * 11/2008 Brown ..... E06B 5/01 292/266
2003/0121232 A1 7/2003 Baptist
2005/0160687 A1 * 7/2005 Corry ..... E06B 5/01 52/107
2006/0162263 A1 7/2006 Ludwig
2008/0209823 A1 * 9/2008 Gernstein ..... E04F 17/06 52/107
2011/0314743 A1 * 12/2011 Warner ..... E04F 17/06 49/358

FOREIGN PATENT DOCUMENTS

GB 2372927 * 4/2002

* cited by examiner

*Primary Examiner* — Quang D Thanh
*Assistant Examiner* — Joseph Iskra

(57) ABSTRACT

A heated window covering device heats an area surrounding a window and ensures an escape through the window in the event of an emergency. The device includes a frame configured for coupling to an opening of a window well. A lid is coupled to the frame and is pivotable between an opened position and a closed position wherein the lid is configured for exposing the opening when the lid is in the opened position. A plurality of heating elements is positioned in the lid wherein the heating elements are configured to melt snow abutted against the lid such that the lid is freely pivotable between the opened and closed positions. A panic plate is operationally coupled to the lid. A lock assembly couples the panic plate and the lid wherein pressing on the panic plate is configured to retract the lock assembly and actuate the lid to the opened position.

17 Claims, 7 Drawing Sheets

HEATED WINDOW COVERING DEVICE

BACKGROUND OF THE DISCLOSURE

Field of the Disclosure

The disclosure relates to window coverings and more particularly pertains to a new window covering device for heating an area surrounding a window and ensuring an escape path through the window in the event of an emergency.

SUMMARY OF THE DISCLOSURE

An embodiment of the disclosure meets the needs presented above by generally comprising a frame configured for coupling to an opening of a window well. A lid is coupled to the frame and is pivotable between an opened position and a closed position wherein the lid is configured for exposing the opening when the lid is in the opened position. A plurality of heating elements is positioned in the lid wherein the heating elements are configured to melt snow abutted against the lid such that the lid is freely pivotable between the opened and closed positions. A panic plate is operationally coupled to the lid. A lock assembly couples the panic plate and the lid wherein pressing on the panic plate is configured to retract the lock assembly and actuate the lid to the opened position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
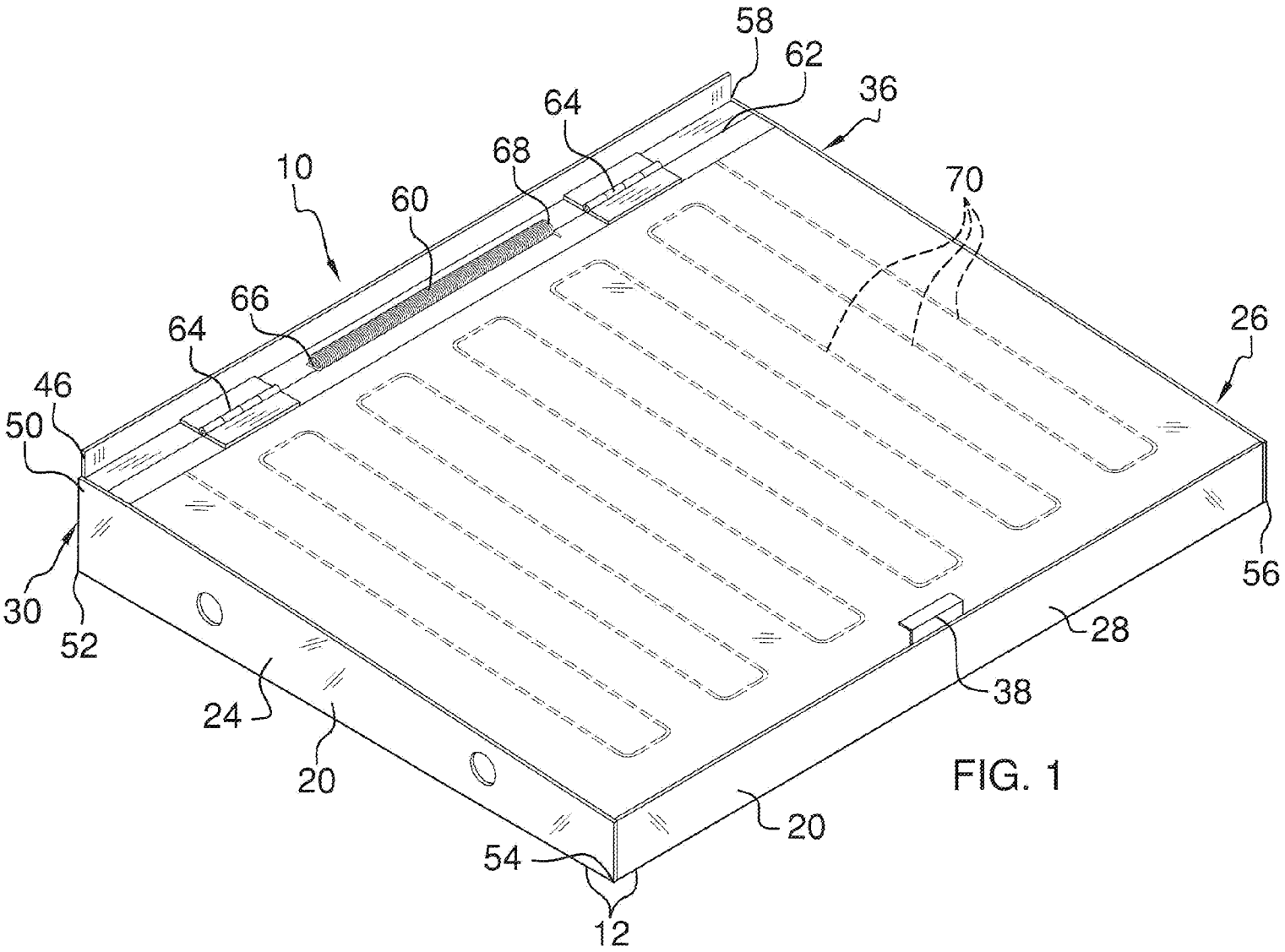
FIG. 1 is a top front side perspective view of a heated window covering device according to an embodiment of the disclosure.
Figure 2:
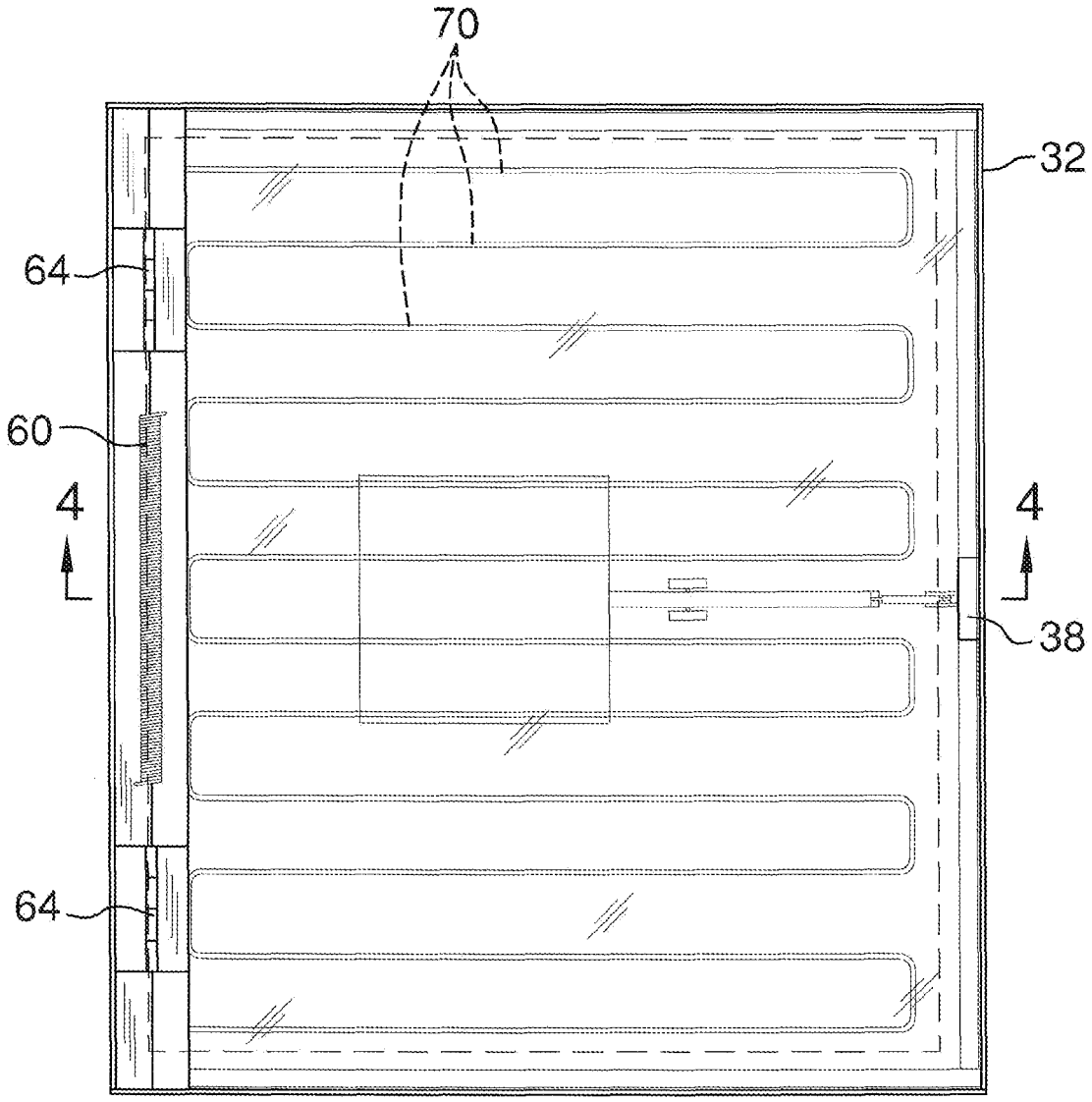
FIG. 2 is a top view of an embodiment of the disclosure.
Figure 3:
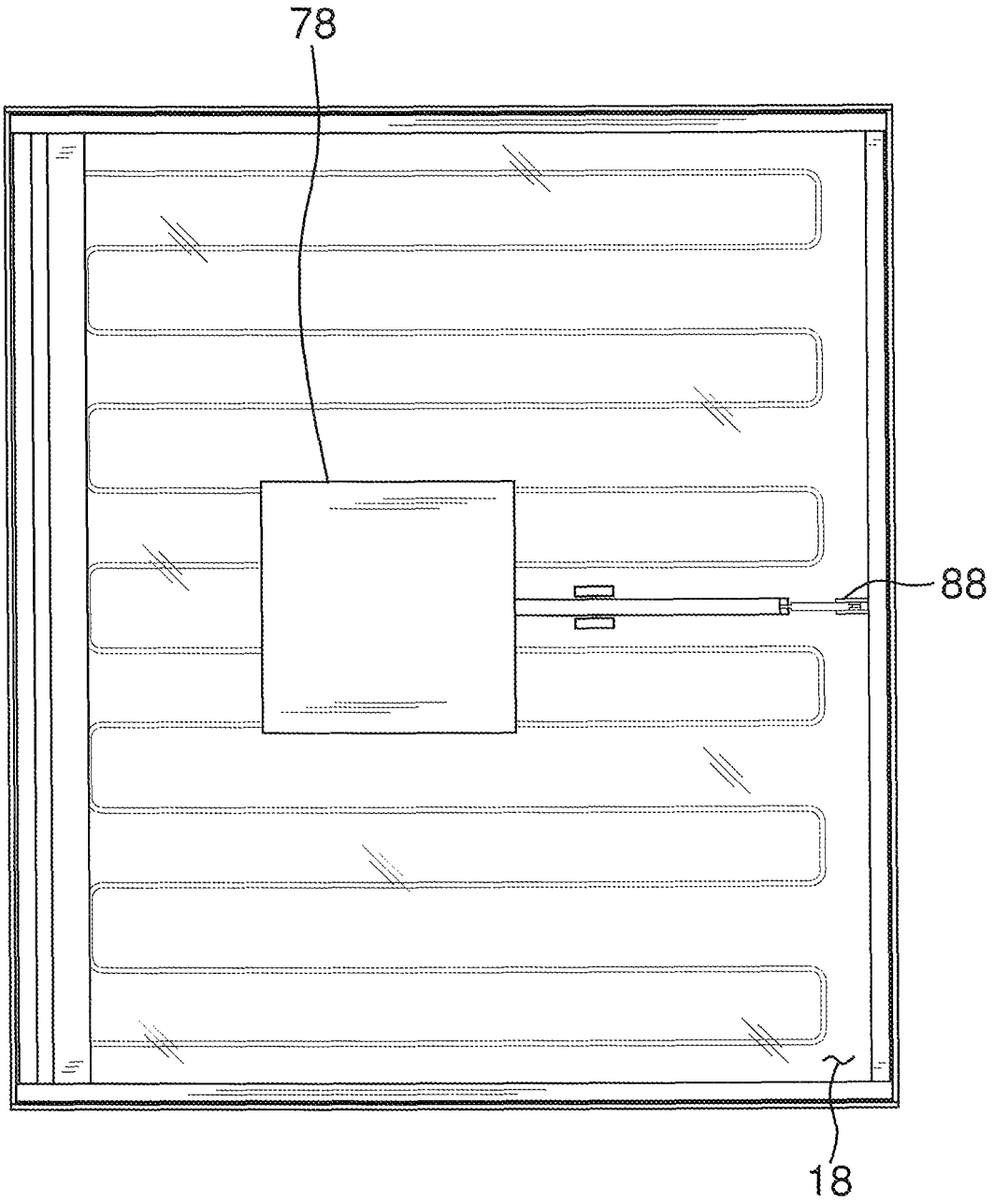
FIG. 3 is a bottom view of an embodiment of the disclosure.
Figure 4:
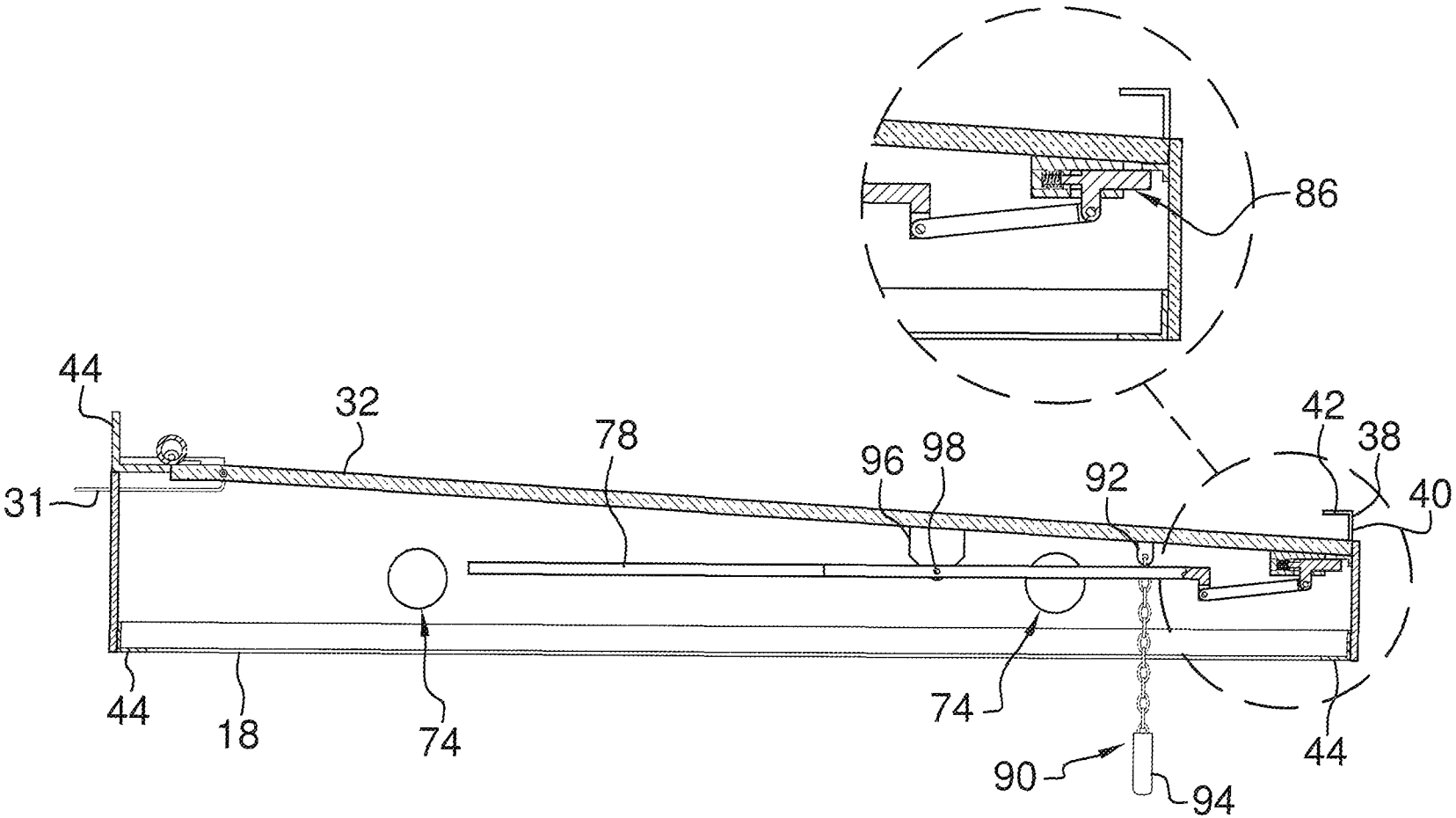
FIG. 4 is a cross-sectional side view of an embodiment of the disclosure taken along line 4-4 of FIG. 2.
Figure 5:
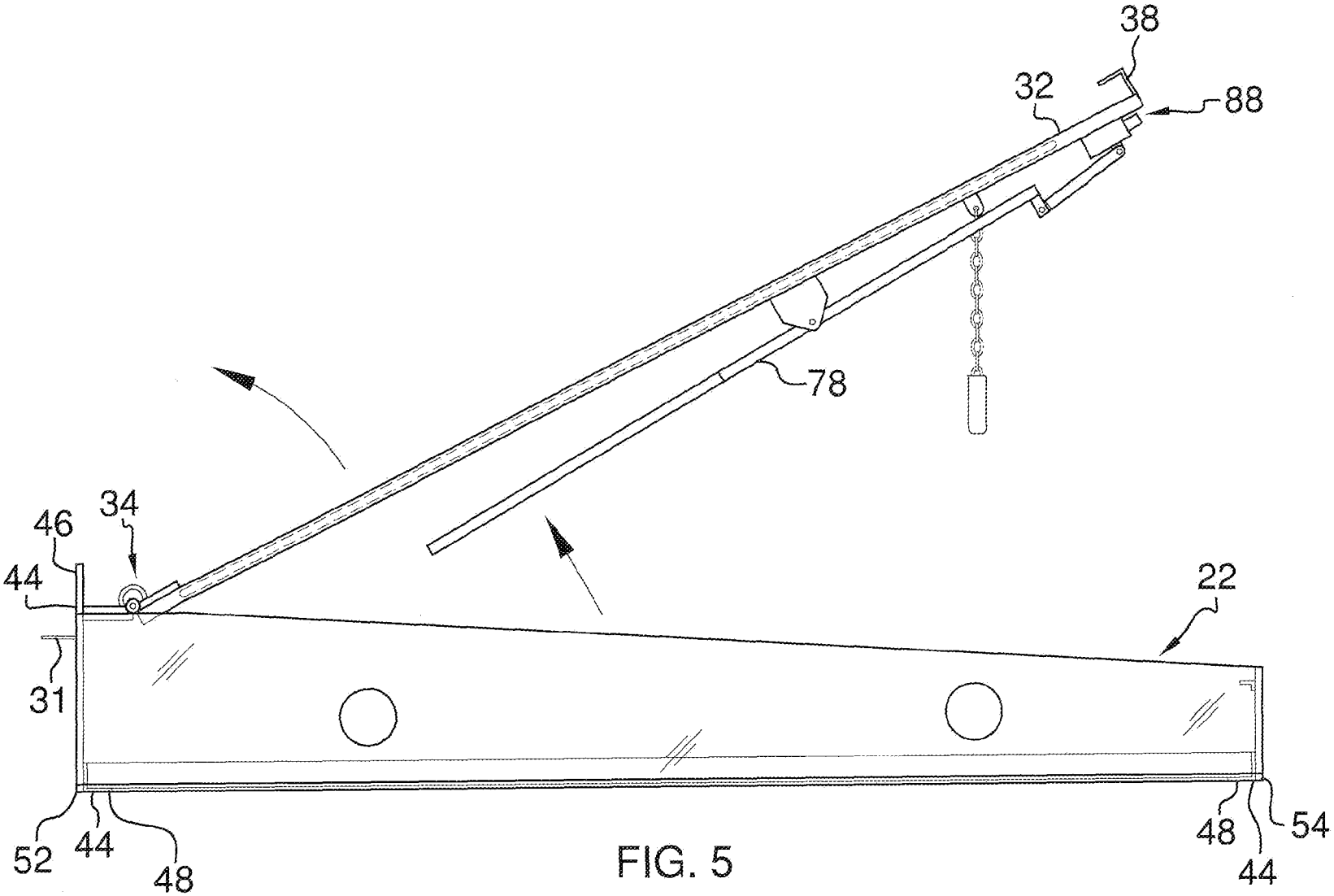
FIG. 5 is a side view of an embodiment of the disclosure.
Figure 6:
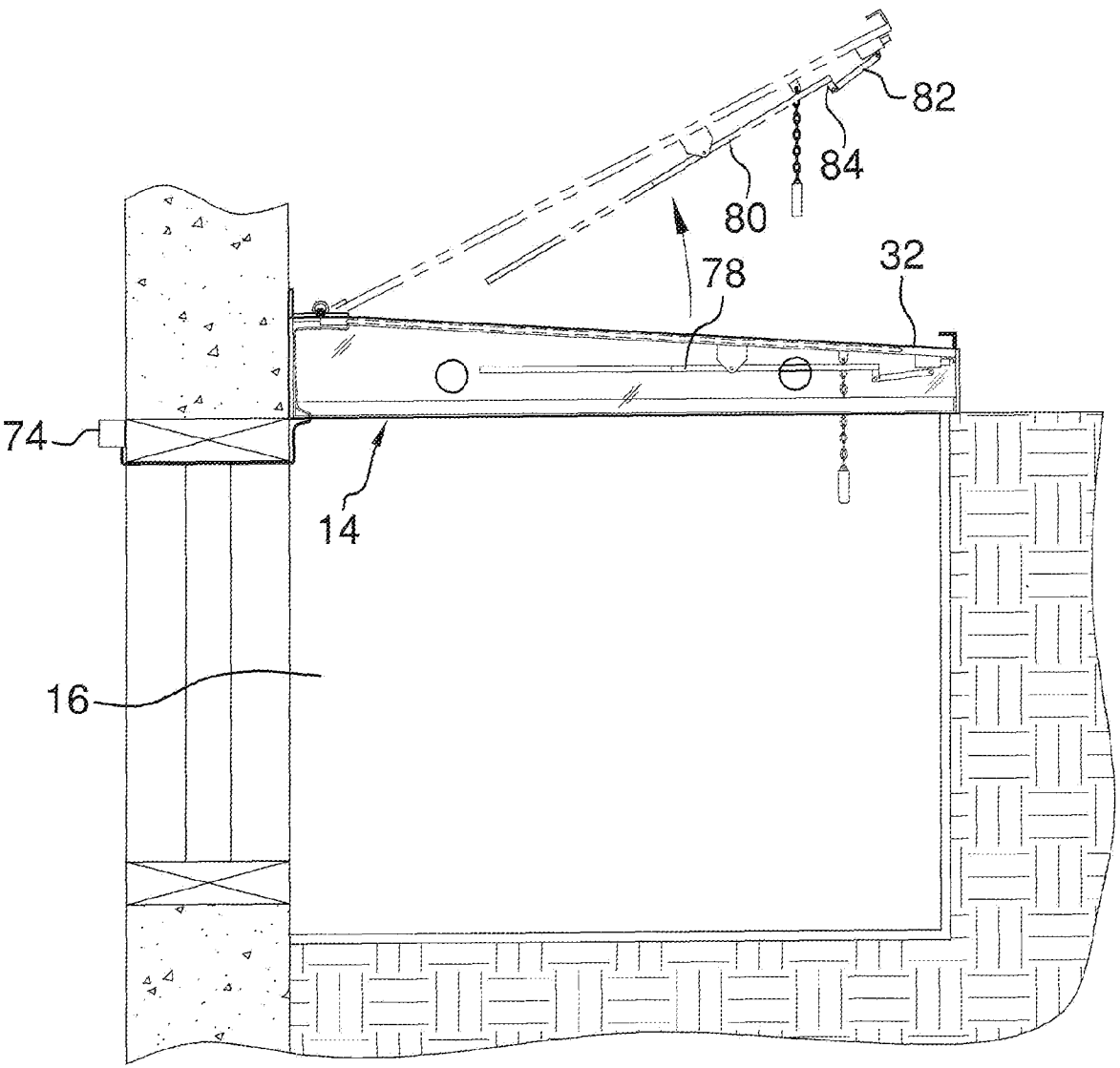
FIG. 6 is a side view of an embodiment of the disclosure in use.
Figure 7:
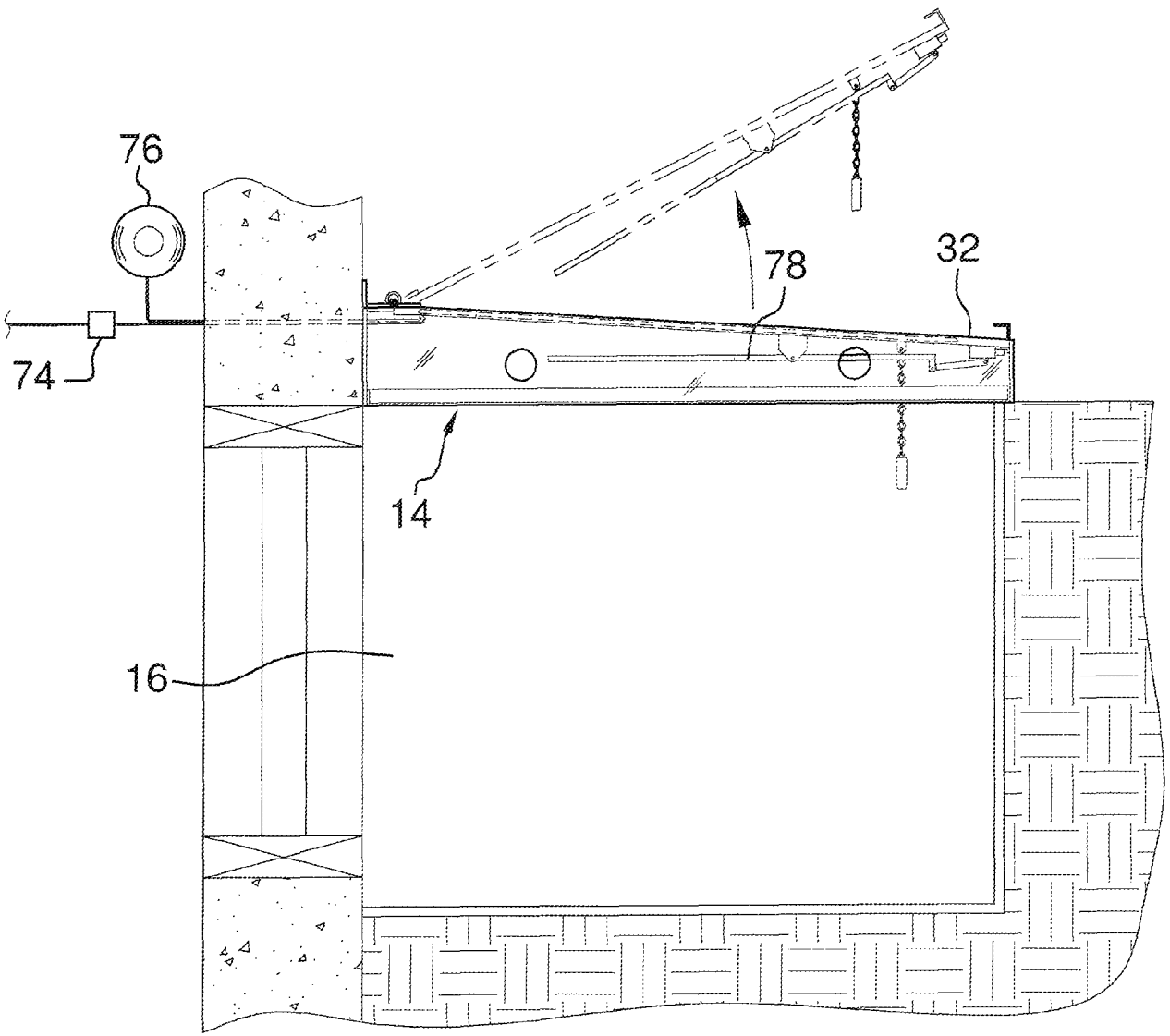
FIG. 7 is a side view of an embodiment of the disclosure in use.

With reference now to the drawings, and in particular to FIGS. 1 through 7 thereof, a new window covering device embodying the principles and concepts of an embodiment of the disclosure and generally designated by the reference numeral 10 will be described.

As best illustrated in FIGS. 1 through 7, the heated window covering device 10 generally comprises a frame 12 configured for coupling to an opening 14 of a window well 16 for an egress window. The device 10 can be retrofitted to any size window well 16. The device 10 prevents animals and children from falling into the well 16 and being injured. The frame 12 comprises a bottom wall 18 and a peripheral wall 20 extending upwardly from the bottom wall 18. The bottom wall 18 and the peripheral wall 20 define an interior space 22 of the frame 12. The peripheral wall 18 comprises a first side 24, a second side 26, a front side 28, and a back side 30. The back side 30 extends between the first side 24 and the second side 26. The frame 12 is preferably constructed from acyclic glass. All other features of the device 10 are preferably constructed from aluminum to prevent the features from rust and corrosion. A plurality of mounting brackets 31 may be mounted to the frame 12 to facilitate mounting of the device 10 to the opening 14. A plurality of fasteners may be coupled to the frame 12.

A lid 32 is removably coupled to the frame 12. The lid 32 preferably overhangs the peripheral wall 18 to prevent leakage and keep the device 10 from freezing shut. The lid 32 is pivotable between an opened position 34 and a closed position 36 wherein the lid 32 is configured for exposing the opening 14 of the window well 16 when the lid 32 is in the opened position 34 and closing the opening 14 when the lid 32 is in the closed position 36. The lid 32 is positioned in the interior space 22 when the lid 32 is in the closed position 36. The lid 32 is configured to pivot away from the opening 14 of the window well 16 when the lid 32 is pivoted to the opened position 34.

A plurality of brackets 44 is coupled to the frame 12. The brackets 44 may comprise an exterior bracket 46 and a plurality of interior brackets 48 wherein the interior brackets 48 are positioned within the interior space 22 of the frame 12 and the exterior bracket 46 is positioned on an exterior 50 of the frame 12. One of the interior brackets 48 may be positioned at a first juncture 52 joining the bottom wall 18, the first side 24, and the back side 30 of the frame 12. One of the interior brackets 48 may be positioned at a second juncture 54 joining the bottom wall 18, the first side 24, and the front side 28 of the frame 12. One of the interior brackets 48 may be positioned at a third juncture 56 joining the bottom wall 18, the second side 26, and the front side 28 of the frame 12. One of the interior brackets 48 may be positioned at a fourth juncture 58 joining the bottom wall 18, the second side 26, and the back side 30 of the frame 12. The exterior bracket 46 may be coupled to the back side 30 of the frame 12 and extend between the first 24 and second 26 sides of the frame 12. Each of the brackets 44 is preferably L-shaped.

A biasing member 60 couples the lid 32 and the frame 12. The biasing member 60 is preferably positioned between the exterior bracket 46 and a back edge 62 of the lid 32. The biasing member 60 may comprise a torsion spring. A pair of hinges 64 may couple the lid 32 and the frame 12 wherein the hinges 64 are configured to pivot the lid 32 between the opened and closed positions 34, 36. One of the hinges 64 may be positioned proximate a first end 66 of the biasing member 60. One of the hinges 64 may be positioned proximate a second end 68 of the biasing member 60.

A plurality of heating elements 70 are provided and may be positioned in the lid 32 wherein the heating elements 70 are configured to melt snow abutted against the lid 32 such that the lid 32 is freely pivotable into and out of the opening 14 of the window well 16. The heating elements 70 may also be positioned proximate the peripheral wall 20 so that the frame 12 does not freeze shut. The heating elements 70 help prevent a buildup of rain and snow in the well 16 and in so doing, help prevent flood damage. The heating elements 70 may comprise heating coils heated by 110 Voltage. A plurality of apertures 72 may be positioned in the frame 12 wherein the apertures 72 are configured to ventilate the interior space 22 when the lid 32 is in the closed position 36 and the heating elements 70 are actuated. A pair of the apertures 72 is preferably positioned in at least one of the first side 24 and the second side 26 of the frame 12.

A thermostat 74 is configured to monitor a temperature of an external environment relative to the window well 16. The thermostat 74 may be electrically coupled to a smoke alarm 76 such that the smoke alarm 76 transmits a temperature signal to the thermostat 74 when the smoke alarm 76 receives a smoke signal from the external environment. In the embodiment using the smoke alarm 76, the thermostat 74 may be hard-wired to the smoke alarm 76. A panic plate 78 is positioned between the lid 32 and the frame 12. The panic plate 78 is operationally coupled to the lid 32. The panic plate 78 comprises a first portion 80 offset from a second portion 82. The panic plate 78 has a medial portion 84 extending between the first and second portions 80, 82. Some of the first portion 80 may include tubing.

A lock assembly 86 couples the panic plate 78 and the lid 32. The lock assembly 86 may comprise a release latch 88 wherein pressing on the panic plate 78 is configured to manually retract the lock assembly 86 and actuate the lid 32 to the opened position 34. The lock assembly 86 is operationally coupled to the thermostat 74 wherein the lock assembly 86 is configured to automatically retract when the lock assembly 86 receives the temperature signal from the thermostat 74 upon the thermostat 74 reaching a threshold temperature or upon the thermostat 74 receiving the smoke signal from the smoke alarm 76. The lock assembly 86 is preferably electromagnetic wherein the lid 32 is secured in the closed position 36 when an electromagnet attracts a conductor with sufficient force. The lock assembly 86 is preferably spring loaded. A motorized lift 89 may be provided and activated when the smoke alarm 76 is triggered to provide an escape route through the window.

A chain 90 may be coupled to a projection 92 of the lid 32. The chain 90 extends downwardly from the projection 92. The chain 90 has a grip 94 configured for manual pulling by a user. The chain 90 is preferably positioned nearer the front side 28 than the back side 30 of the frame 12. The chain 90 is operationally coupled to the lock assembly 86 wherein pulling on the chain 90 retracts the lock assembly 86 and actuates the lid 32 to the opened position 34. A coupler 96 couples the lid 32 and the panic plate 78 at a pivot point 98 wherein the pivot point 98 is configured to enable the lid 32 to transition from the closed position 36 to the opened position 34 when the lock assembly 86 is retracted. A handle 38 may be coupled to the lid 32. The handle 38 preferably extends upwardly and outwardly from the lid 32 wherein the handle 38 is configured for manual grasping by a user. The handle 38 is operationally coupled to the lock assembly 86 wherein pulling the handle 38 detaches the lock assembly 86 and pivots the lid 32 to the opened position 34. The handle 38 may be L-shaped and comprise a first portion 40 and a second portion 42. The first portion 40 is preferably aligned with the front side 28 of the frame 12. The second portion 42 preferably extends toward the back side 30 of the frame 12.

The first side 24 and the second side 26 of the frame each have a length between approximately 2.0 centimeters and 20.0 centimeters. The front side 28 has a length between approximately 5.0 centimeters and 10.0 centimeters. The back side 30 has a length between approximately 10.0 centimeters and 20.0 centimeters. Each of the apertures 72 has a diameter between approximately 2.0 centimeters and 8.0 centimeters. The panic plate 78 has a length and a width each between approximately 20.0 centimeters and 40.0 centimeters. The panic plate 78 has a depth between approximately 0.2 centimeters and 2.0 centimeters. The exterior bracket 46 has a length and a width each between approximately 2.0 centimeters and 8.0 centimeters. The exterior bracket has a depth between approximately 0.05 centimeters and 1.30 centimeters.

In use, as stated above and shown in the Figures, the device provides a covering for an egress window. Heating elements 70 provide heat to the area surrounding the window well 16 to ensure an escape path into and out of the well 16 in the event of an emergency. The lid 32 automatically opens when the smoke alarm 76 is triggered. The lid 32 is opened manually by pushing the panic plate 78, pulling the chain 90, or pulling the handle 38. The apertures 72 provide ventilation to the device 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A heated window covering device comprising:

a frame configured for coupling to an opening of a window well;

a lid coupled to said frame, said lid being pivotable between an opened position and a closed position wherein said lid is configured for exposing the opening of the window well when said lid is in the opened position and closing the opening when said lid is in the closed position;

a plurality of heating elements being positioned in said lid wherein said heating elements are configured to melt snow abutted against said lid such that said lid is freely pivotable between the opened and closed positions;

a panic plate positioned between said lid and said frame, said panic plate being operationally coupled to said lid;

a lock assembly coupling said panic plate and said lid, said lock assembly comprising a release latch wherein pressing on said panic plate is configured to manually retract said lock assembly and actuate said lid to the opened position;

a thermostat configured to monitor a temperature of an external environment relative to the window well, said thermostat being electrically coupled to a smoke alarm such that the smoke alarm transmits a temperature signal to said thermostat when the smoke alarm receives a smoke signal from the external environment; and wherein said lock assembly is operationally coupled to said thermostat such that said lock assembly is configured to automatically retract when said lock assembly receives the temperature signal from said thermostat upon said thermostat reaching a threshold temperature or upon said thermostat receiving the smoke signal from the smoke alarm.

2. The device of claim 1, further comprising said frame having a bottom wall and a peripheral wall extending upwardly from said bottom wall, said bottom wall and said peripheral wall defining an interior space of said frame, said peripheral wall comprising a first side, a second side, a front side, and a back side, said back side extending between said first side and said second side.

3. The device of claim 2, further comprising said lid being positioned in said interior space when said lid is in the closed position, said lid being configured to pivot away from the opening of the window well when said lid is pivoted to the opened position.

4. The device of claim 3, further comprising a plurality of brackets coupled to said frame, each of said brackets being L-shaped, said brackets comprising an exterior bracket and a plurality of interior brackets wherein said interior brackets are positioned within said interior space of said frame and said exterior bracket is positioned on an exterior of said frame.

5. The device of claim 4, further comprising one of said interior brackets being positioned at a first juncture joining said bottom wall, said first side, and said back side of said frame, one of said interior brackets being positioned at a second juncture joining said bottom wall, said first side, and said front side of said frame, one of said interior brackets being positioned at a third juncture joining said bottom wall, said second side, and said front side of said frame, one of said interior brackets being positioned at a fourth juncture joining said bottom wall, said second side, and said back side of said frame, said exterior bracket being coupled to said back side of said frame and extending between said first and second sides of said frame.

6. The device of claim 1, further comprising said lid being removably coupled to said frame.

7. The device of claim 6, further comprising a pair of hinges coupling said lid and said frame wherein said hinges are configured to pivot said lid between the opened and closed positions.

8. The device of claim 7, further comprising:

a biasing member coupling said lid and said frame, said biasing member being positioned between an exterior bracket and a back edge of said lid, said biasing member comprising a torsion spring; and one of said hinges being positioned proximate a first end of said biasing member, one of said hinges being positioned proximate a second end of said biasing member.

9. The device of claim 3, further comprising a plurality of apertures positioned in said frame wherein said apertures are configured to ventilate said interior space when said lid is in the closed position and said heating elements are actuated, a pair of said apertures being positioned in at least one of said first side and said second side of said frame.

10. The device of claim 1, further comprising said lock assembly being electromagnetic wherein said lid is secured in the closed position when an electromagnet attracts a conductor with sufficient force.

11. The device of claim 1, further comprising said lock assembly being spring loaded.

12. A heated window covering device comprising:

a frame configured for coupling to an opening of a window well;

a lid coupled to said frame, said lid being pivotable between an opened position and a closed position wherein said lid is configured for exposing the opening of the window well when said lid is in the opened position and closing the opening when said lid is in the closed position;

a plurality of heating elements being positioned in said lid wherein said heating elements are configured to melt snow abutted against said lid such that said lid is freely pivotable between the opened and closed positions;

a panic plate positioned between said lid and said frame, said panic plate being operationally coupled to said lid;

a lock assembly coupling said panic plate and said lid, said lock assembly comprising a release latch wherein pressing on said panic plate is configured to manually retract said lock assembly and actuate said lid to the opened position; and a chain coupled to a projection of said lid, said chain extending downwardly from said projection, said chain having a grip configured for manual pulling by a user, said chain being operationally coupled to said lock assembly wherein pulling on said chain retracts said lock assembly and actuates said lid to the opened position.

13. The device of claim 12, further comprising said chain being positioned nearer a front side than a back side of said frame.

14. The device of claim 1, further comprising a coupler coupling said lid and said panic plate at a pivot point wherein said pivot point is configured to enable said lid to transition from the closed position to the opened position when said lock assembly is retracted.

15. The device of claim 1, further comprising a handle coupled to said lid, said handle extending upwardly and outwardly from said lid wherein said handle is configured for manual grasping by a user, said handle being operationally coupled to said lock assembly wherein pulling said handle detaches said lock assembly and pivots said lid to the opened position.

16. The device of claim 15, further comprising said handle being L-shaped and comprising a first portion coupled to a second portion, said first portion being aligned with a front side of said frame, said second portion extending toward a back side of said frame.

17. A heated window covering device comprising:

a frame configured for coupling to an opening of a window well, said frame comprising a bottom wall and a peripheral wall extending upwardly from said bottom wall, said bottom wall and said peripheral wall defining an interior space of said frame, said peripheral wall comprising a first side, a second side, a front side, and a back side, said back side extending between said first side and said second side;

a lid removably coupled to said frame, said lid being pivotable between an opened position and a closed position wherein said lid is configured for exposing the opening of the window well when said lid is in the opened position and closing the opening when said lid is in the closed position, said lid being positioned in said interior space when said lid is in the closed position, said lid being configured to pivot away from the opening of the window well when said lid is pivoted to the opened position;

a plurality of brackets coupled to said frame, said brackets comprising an exterior bracket and a plurality of interior brackets wherein said interior brackets are positioned within said interior space of said frame and said exterior bracket is positioned on an exterior of said frame, one of said interior brackets being positioned at a first juncture joining said bottom wall, said first side, and said back side of said frame, one of said interior brackets being positioned at a second juncture joining said bottom wall, said first side, and said front side of said frame, one of said interior brackets being positioned at a third juncture joining said bottom wall, said second side, and said front side of said frame, one of said interior brackets being positioned at a fourth juncture joining said bottom wall, said second side, and said back side of said frame, said exterior bracket being coupled to said back side of said frame and extending between said first and second sides of said frame, each of said brackets being L-shaped;

a biasing member coupling said lid and said frame, said biasing member being positioned between said exterior bracket and a back edge of said lid, said biasing member comprising a torsion spring;

a pair of hinges coupling said lid and said frame wherein said hinges are configured to pivot said lid between the opened and closed positions, one of said hinges being positioned proximate a first end of said biasing member, one of said hinges being positioned proximate a second end of said biasing member;

a plurality of heating elements being positioned in said lid wherein said heating elements are configured to melt snow abutted against said lid such that said lid is freely pivotable into and out of the opening of the window well;

a plurality of apertures positioned in said frame wherein said apertures are configured to ventilate said interior space when said lid is in the closed position and said heating elements are actuated, a pair of said apertures being positioned in at least one of said first side and said second side of said frame;

a thermostat configured to monitor a temperature of an external environment relative to the window well, said thermostat being electrically coupled to a smoke alarm such that the smoke alarm transmits a temperature signal to said thermostat when the smoke alarm receives a smoke signal from the external environment;

a panic plate positioned between said lid and said frame, said panic plate being operationally coupled to said lid;

a lock assembly coupling said panic plate and said lid, said lock assembly comprising a release latch wherein pressing on said panic plate is configured to manually retract said lock assembly and actuate said lid to the opened position, said lock assembly being operationally coupled to said thermostat wherein said lock assembly is configured to automatically retract when said lock assembly receives the temperature signal from said thermostat upon said thermostat reaching a threshold temperature or upon said thermostat receiving the smoke signal from the smoke alarm, said lock assembly being electromagnetic wherein said lid is secured in the closed position when an electromagnet attracts a conductor with sufficient force, said lock assembly being spring loaded;

a chain coupled to a projection of said lid, said chain extending downwardly from said projection, said chain having a grip configured for manual pulling by a user, said chain being positioned nearer to said front side than to said back side of said frame, said chain being operationally coupled to said lock assembly wherein pulling on said chain retracts said lock assembly and actuates said lid to the opened position;

a coupler coupling said lid and said panic plate at a pivot point wherein said pivot point is configured to enable said lid to transition from the closed position to the opened position when said lock assembly is retracted; and a handle coupled to said lid, said handle extending upwardly and outwardly from said lid wherein said handle is configured for manual grasping by a user, said handle being operationally coupled to said lock assembly wherein pulling said handle detaches said lock assembly and pivots said lid to the opened position, said handle being L-shaped and comprising a first portion coupled to a second portion, said first portion being aligned with said front side of said frame, said second portion extending toward said back side of said frame.

* * * * *